US008226291B2

(12) United States Patent
Zamirowski et al.

(10) Patent No.: US 8,226,291 B2
(45) Date of Patent: Jul. 24, 2012

(54) ADJUSTABLE ORBIT IMBALANCE COMPENSATING ORBITAL SHAKER

(75) Inventors: Erik Zamirowski, Branchburg, NJ (US); Ashvin Joshi, Clifton, NJ (US); Heinz G. Koehn, Hamburg (DE); Joel Johnson, Port Monmouth, NJ (US)

(73) Assignee: New Brunswick Scientific Co., Inc., Enfield, CT (US)

( * ) Notice: Subject to any disclaimer, the term of this patent is extended or adjusted under 35 U.S.C. 154(b) by 0 days.

(21) Appl. No.: 13/114,280

(22) Filed: May 24, 2011

(65) Prior Publication Data

US 2011/0286298 A1 Nov. 24, 2011

Related U.S. Application Data

(60) Provisional application No. 61/347,484, filed on May 24, 2010.

(51) Int. Cl.
*B01F 11/00* (2006.01)

(52) U.S. Cl. ..... 366/208

(58) Field of Classification Search ..... 366/108–117, 366/124, 128, 208–219; 74/86–87
See application file for complete search history.

(56) References Cited

U.S. PATENT DOCUMENTS

| | | | | |
|---|---|---|---|---|
| 2,255,799 | A * | 9/1941 | Meinzer | 366/111 |
| 3,430,926 | A * | 3/1969 | Liobis et al. | 366/212 |
| 4,047,704 | A * | 9/1977 | Hawrylenko | 366/198 |
| 4,673,297 | A * | 6/1987 | Siczek et al. | 366/208 |
| 5,060,151 | A * | 10/1991 | Mikyska et al. | 700/90 |
| 5,372,425 | A * | 12/1994 | Tannenbaum et al. | 366/208 |
| 5,558,437 | A * | 9/1996 | Rode | 366/208 |
| 5,593,228 | A * | 1/1997 | Tannenbaum | 366/209 |
| 6,106,143 | A | 8/2000 | Nickel et al. | |
| 6,190,032 | B1 * | 2/2001 | Choda | 366/208 |
| 7,318,667 | B2 * | 1/2008 | Stalec et al. | 366/208 |
| 7,338,199 | B2 * | 3/2008 | Hafner | 366/208 |
| 8,016,478 | B2 * | 9/2011 | Ebers et al. | 366/208 |
| 2008/0056059 | A1 | 3/2008 | Manera et al. | |
| 2011/0286298 | A1 * | 11/2011 | Zamirowski et al. | 366/111 |

FOREIGN PATENT DOCUMENTS

| | | | |
|---|---|---|---|
| EP | 1854533 | A1 | 11/2007 |
| JP | 02187138 | A * | 7/1990 |

* cited by examiner

*Primary Examiner* — Charles E Cooley
(74) *Attorney, Agent, or Firm* — Fox Rothschild LLP; Richard C. Woodbridge; Perry M. Fonseca

(57) ABSTRACT

An orbital shaker apparatus is provided, including a first shaft connected to a first bearing assembly at a first end and a mounting portion at the other. The first shaft is rotatable about a first shaft axis, and is connected to a motor. The second shaft has a bearing assembly on the mounting portion at one end and a platform at the other, and is aligned parallel to and offset from the first shaft by a distance. A counterweight rotor assembly is coupled to the mounting portion, and rotated by a belt driven by a pulley connected to the rotating shaft of a counterweight motor. The counterweight assembly includes two counterweight bearings, each having a counterweight wedge. The platform also includes supports for objects to be secured thereto. In use, as the counterweight rotor rotates, the second shaft, second bearing assembly, and platform describes a circular orbit with diameter 2R.

16 Claims, 18 Drawing Sheets

MANUAL ADJUSTMENT

SYSTEM BLOCK DIAGRAM (AUTOMATIC)

SYSTEM BLOCK DIAGRAM (MANUAL)

AUTOMATIC ADJUSTMENT

ADJUSTABLE ORBIT IMBALANCE COMPENSATING ORBITAL SHAKER

CROSS-REFERENCE TO RELATED APPLICATIONS

This application claims priority from U.S. Provisional Patent Application No. 61/347,484 filed on May 24, 2010 by Zamirowski, et al. titled "ADJUSTABLE ORBIT IMBALANCE COMPENSATING ORBITAL SHAKER," which is incorporated herein by reference in its entirety.

BACKGROUND OF THE INVENTION

1. Statement of the Technical Field

This invention generally relates to orbital shaker apparatus and, more specifically, to an apparatus for reducing the instability generally caused by static imbalance between a counterweight and the load of flasks or other vessels on the platform, and an apparatus for varying the orbit diameter of the shaker.

2. Description of the Related Art

An orbital shaker apparatus is a mixing or stirring device used especially in scientific applications or mixing or stirring containers, such as beakers and flasks holding various liquids on a platform. Specifically, an orbital shaker translates a platform in a manner such that all points on the upper surface, in the X-Y plane, of the platform move in a circular path having a common radius. Generally, beakers, flasks, and other vessels are attached to the upper surface of the platform such that the liquid contained therein is swirled around the interior side walls of the vessel to increase mixing and increase interaction or exchange between the liquid and local gaseous environment. Conventionally, the apparatus which drives the platform in an orbital translation includes one or more vertical shafts driven by a motor with an offset or crank on the upper end of an uppermost shaft such that the axis of the upper shaft moves in a circle with a radius determined by the offset in the shaft, i.e., by the "crank throw". The upper shaft or shafts are connected to the underside of the platform via a bearing to disconnect the rotational movement between the upper shaft or shafts and the platform.

In operation, the mass of the shaft above the offset or crank throw, the platform with its mounting hardware and the load consisting of the filled flasks or vessels, and the clips or fasteners which hold the vessels to the platform all translate at the rotational velocity of the driven shaft in a circle with a radius equal to the crank throw. The mass of the liquid within the vessels translates at the shaft rotational velocity in a circle with a radius equal to the crank throw plus the distance from the center of the vessel to the center of mass of the liquid contained in the vessel.

The forces resulting from the total orbitally-rotating mass can often cause motion of the base of the shaker which can superimpose additional motion components into the liquid in the vessels and lead to undesirable turbulence or splashing. These forces can also cause the base unit to move or "walk" along its support surface.

In order to reduce this motion, the mass of the non-rotating supporting structure must be increased to resist the forces generated by the rotating mass. This leads to the undesirable effect of increasing the overall weight of the shaker simply to address for stabilization. Alternatively, counterweights have been employed to oppose or compensate for the forces generated from the orbitally-rotating mass.

For example, U.S. Pat. No. 3,430,926 to Freedman, et al., entitled "Counterweight System for Shaker Apparatus," describes the use of multiple fixed counterweights situated about a shaft which counteract the imbalance forces generated by a rotating platform.

U.S. Pat. No. 5,558,437 to Rode, entitled "Dynamically Balanced Orbital Shaker," addresses the issue of static and dynamic imbalance by positioning various fixed masses in the plane of the crank arm such that their masses and placement exactly cancel out the effects of the rotating platform's mass contribution.

Similarly, European Patent Application No. EP1854533 to Hawrylenko, entitled "Shaker," describes a crank arrangement where two balancing masses can be adjusted radially and vertically to compensate for a given loading condition.

These arrangements all undesirably require selecting specific masses and locations, vertically as well as radially, which vary depending upon the platform load conditions. In addition, in order to correct for large mass imbalances statically and dynamically, these devices require considerable space to place the correcting weights in the appropriate locations relative to the platform load, and also increase the overall product weight.

U.S. Pat. No. 6,106,143 to Nickel, et al., entitled "Vibrating Device for Vibrating Liquid Provided in Vessels," provides a means to adjust a static counterweight to compensate for a range of platform loads by advancing or retracting a mass radially along an axis. The distance between the center of mass of the counterweight and the axis of rotation increases or decreases, and thus generates an increased or decreased amount of balance compensation. This is a practical solution for modest platform loads but is not feasible for providing a large dynamic compensation range. For example, if a large counterweight mass is selected, it may not be positioned close enough to the axis of rotation to achieve a minimal balance compensation. If a small counterweight is selected, it is difficult to position it far enough from the axis of rotation to balance a large platform load without using considerable additional space. Also, this device does not provide any feedback to the user that the onset of detrimental instability is imminent, which would require a compensating adjustment.

U.S. Patent Application Publication Serial No. US2008/0056059 to Manera, et al. describes the use of a vibration sensor to detect an unbalanced loading condition and reduce the shaking speed to a stable magnitude, but it does not provide a means for the counterweight of the orbital shaker to be adjusted, or a process which can be applied, in order to achieve the desired speed.

There are rotating equipment in other technical fields that use balancing heads to correct for rotor imbalances using two aims with weights. See, for example, Mechanical Vibrations, J. P. Den Hartog 1934, pp. 236-237 ISBN 0-486-64785-4. However, orbital shakers tend to differ because the platform load includes not only a static mass component, but also a dynamic component, namely the fluid in the flasks or other containers. This fluid generates a variable imbalance depending upon the geometry of the container, amount of fluid in the container, the orbit diameter of the shaker, and the speed of the shaker which could result in a different amount of resultant balance compensation depending upon the operating conditions. Furthermore, automatic balancing techniques, whereby balancing masses migrate to the correct positions to minimize vibrations, are not generally applicable to orbital shakers because orbital shakers operate much slower than the critical speeds required to enable these techniques.

The eccentric throw for an orbital shaker is typically fixed by precisely machining a single component. The offset between the two eccentric journals defines the orbit radius. This radius is not adjustable. Adjusting the eccentric throw by separating the two journals into independent bearing housings whose centers of rotation can be fixed at different eccentric offsets relative to each other is a method which is known in prior art, such as, for example, the Kuehner shaker. What has not been achieved is a means of manually or automatically adjusting the eccentric throw within a continuously variable range. Furthermore, a change in the eccentric throw for a given platform load results in a change in the amount of counterweight needed to compensate for it. Thus, it is desired to combine the ability to adjust the eccentric throw with the ability to adjust the compensating counterweight simultaneously.

It is also desirable for an orbital shaker device to provide feedback to the user, or, in the case of a shaker with automatic adjustment, to provide feedback to its controller that the onset of detrimental instability which would require a compensating adjustment is imminent.

It is also desirable to provide an orbital shaker capable of balancing a large platform using counterweights of intermediate size without requiring a device of unreasonable size or weight.

SUMMARY OF THE INVENTION

An aspect of the present invention provides an orbital shaker apparatus including a first shaft rotatable about a first axis with a mounting portion, a first bearing assembly receiving the first shaft and mounted to the shaker chassis, a second shaft rotatable about a second axis offset from said first axis and including a platform portion, a second bearing assembly receiving the second shaft, a counterweight rotor assembly mounted between the mounting portion of the first shaft and the mounting portion of the second shaft, the counterweight rotor assembly extending radially around the first shaft. A platform is connected to the bearing assembly of said second shaft such that rotation of the platform occurs in an orbital manner about the first axis. Two equal counterweights are positioned in the counterweight rotor assembly, the counterweights having a fixed radial position but being adjustable in the circumferential direction to facilitate a variable counterweight balance such that a static balance between the platform load and the counterweights about the first shaft axis may be achieved. Also provided is a means of detecting static imbalance between the platform load and the counterweights.

In another aspect of the invention, these features allow the user to adjust the position of the counterweights in response to the noticeable imbalance of the system or information provided by the orbital shaker controller to minimize the static imbalance or reduce it to an acceptable level.

Additionally, a sliding connection placed between the mounting portions of the first and second shafts allows adjustment of the eccentric orbit by moving the shaft axes relative to each other.

In another aspect of the invention, actuators and sensors can be added to the system, which, under the direction of the controller, allow automatic adjustment of the counterweights in response to detected static imbalances, as well as automatic adjustment of the eccentric orbit to a user-specified distance.

BRIEF DESCRIPTION OF THE DRAWINGS

The novel features believed characteristic of the invention are set forth in the appended claims. The invention itself, however, as well as a best mode of use, further purposes and advantages thereof, will best be understood by reference to the following detailed description of an illustrative embodiment when read in conjunction with the accompanying drawings, where:

DETAILED DESCRIPTION OF THE INVENTION

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention.

During the course of this description like numbers will be used to identify like elements according to the different views which illustrate the invention.

The present invention advantageously provides an orbital shaker device with the ability to adjust the eccentric throw and to adjust the compensating counterweights simultaneously.

The present invention also advantageously provides an orbital shaker device that provides feedback to the user, or, in the case of a shaker with automatic adjustment, that provides feedback to it's controller that the onset of detrimental instability which would require a compensating adjustment is imminent The present invention also provides an orbital shaker capable of balancing a large platform using counterweights of intermediate size without requiring a device of unreasonable size and weight.

Figure 1:
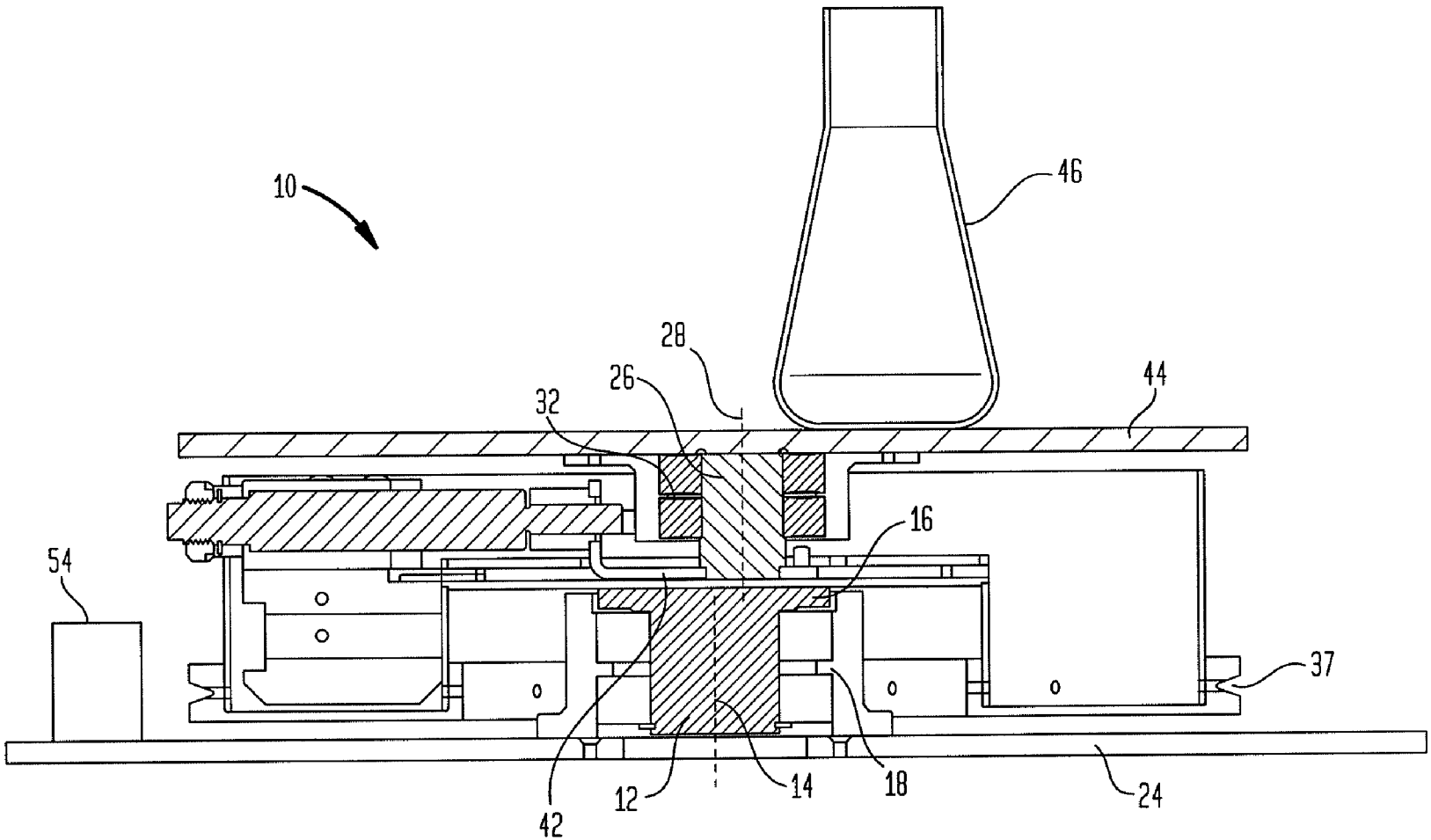
FIG. 1 is a schematic elevation section view depicting the general arrangement of the components, in accordance with an embodiment of the invention.

FIG. 1 illustrates the preferred embodiment of the invention 10 which allows manual adjustment of the counterweights and the eccentric crank throw. This embodiment includes a first shaft 12 and first bearing assembly 18, a second shaft 26 and second bearing assembly 32, a shaft slide 42, and a counterweight rotor assembly 38. Also included is the first bearing housing 20 and first shaft bearings 22, as well as second shaft mounting portion 30, the second bearing housing 34 and second shaft bearings 36.

The first bearing assembly 18 is preferably rigidly coupled to the shaker chassis 24 and is thereby constrained from rotation. The first shaft 12 is connected to the first bearing assembly 18 by bearings so that it is free to rotate about the first shaft axis 14. The mounting portion 16 of the first shaft 12 is rigidly coupled to the counterweight rotor assembly 38, visible in FIG. 2, so that the rotor can rotate in unison with the first shaft 12.

Figure 2:
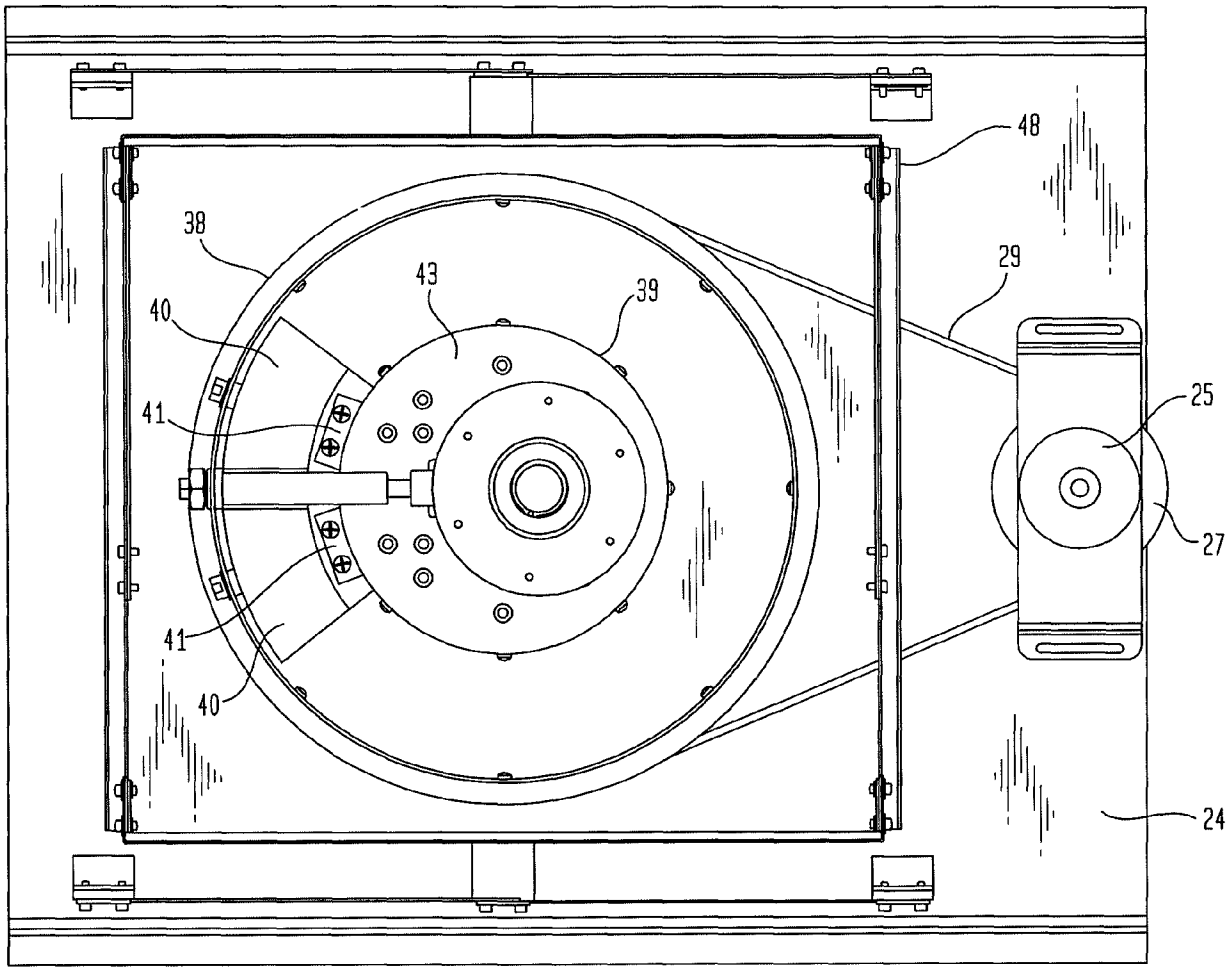
FIG. 2 is a top view of the embodiment of the invention depicted in FIG. 1.

As seen in FIG. 2, the counterweight rotor assembly 38 is centrally located, and is rotated by a belt 29 which is driven by a pulley 27 connected to the rotating shaft of a motor 25 mounted to the chassis 24. The rotor consists of a drum with a pulley groove 37 around its circumference at the lower edge. This drum has a central raised area which forms a pedestal 39. This pedestal portion is rigidly coupled to the first shaft 12.

The counterweight rotor assembly 38 also contains two counterweight bearings 41 which are attached to the counterweight wedges 40. Counterweight bearings 41 are free to rotate about the rotor assembly pedestal but constrained from vertical motion by a cap 43 on the pedestal 39.

A platform 44 for supporting flasks 46 or other containers (not depicted) to be shaken is mounted to the second shaft bearing assembly 32. The platform 44 assembly could be further subdivided into a subplatform which is reinforced for stiffness and connected to the second bearing assembly 32, as well as a tray where the flasks are mounted. A subplatform and tray can be connected by lockable, linear guides so that the tray can be moved to a more ergonomically acceptable position closer to the user in the typical case where the orbital shaker is enclosed in a cabinet with a door to maintain the atmosphere to which the agitated samples are exposed.

The second shaft axis 28 is offset from the first shaft axis 14 by a distance R. As the counterweight rotor 38 turns, the second shaft 26 and second bearing assembly 32 describe a circular orbit with diameter 2R about the first shaft axis 14. Platform 44 is constrained to a circular orbit by virtue of this offset as well as its connection to a flexure assembly 48. Flexure assembly 48 is a typical leaf spring linkage to limit the platform's remaining degrees of freedom to pure rotation. The pairs of flexure springs are orthogonal to each other and constrained so that they may move in only one direction, e.g., left/right or front/back. One pair is connected to the platform 44, while the other pair is connected to the chassis 24. Both pairs are connected and kept orthogonal to each other through a rigid mechanical frame. For compactness, to consolidate all the springs in one plane, and to increase the axial stiffness of the springs in the longer platform direction and eliminate a cantilever, the leaf springs which move in the front/back direction connect to the chassis at their ends, and connect to the mechanical frame in the middle.

In an alternate embodiment, the platform's unconstrained degrees of freedom are limited by at least two additional eccentric shafts and bearing assemblies (not depicted) mounted between the platform 44 and chassis 24, as is typical in triple eccentric bearing housing designs.

Figure 3A:
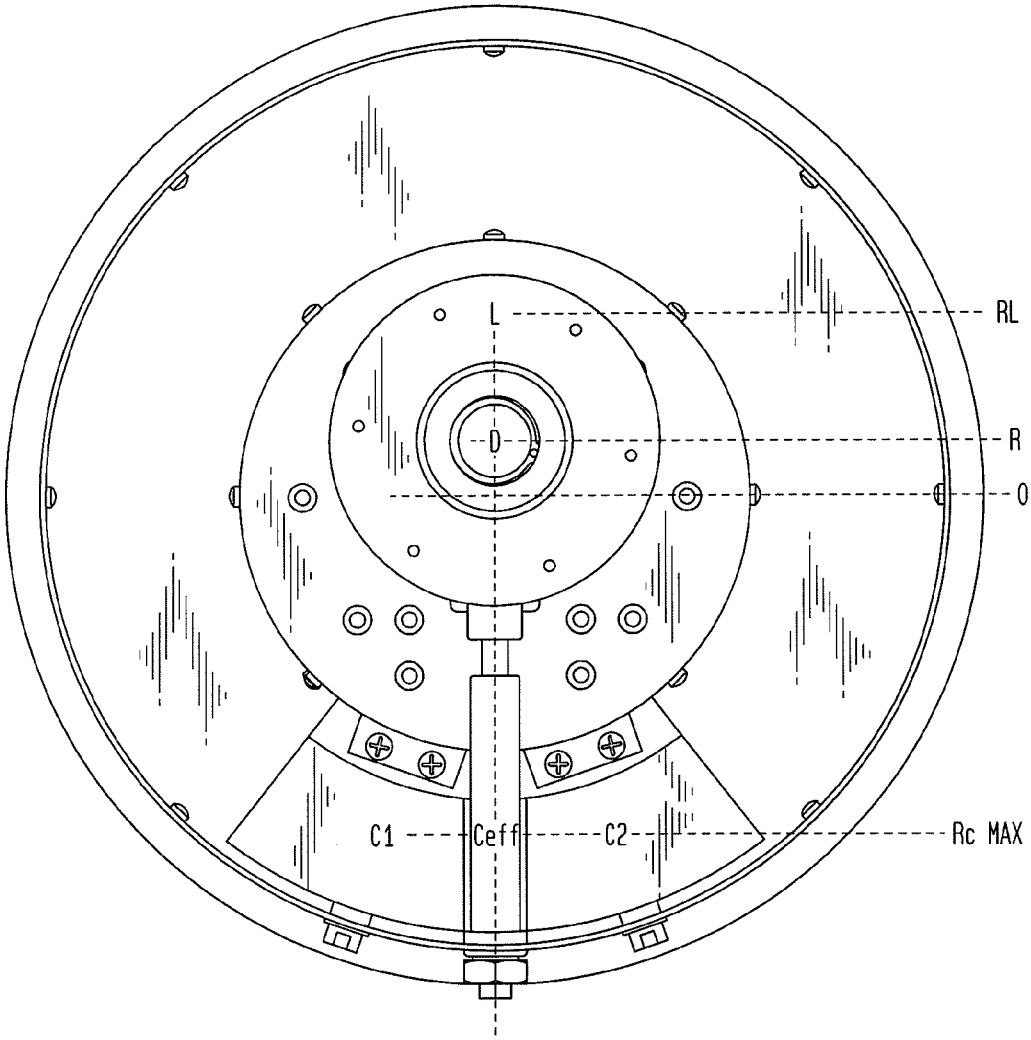
FIG. 3A is a top view of a counterweight rotor assembly with the platform removed for clarity, to illustrate the principles of imbalance compensation using counterweight wedges, in accordance with an embodiment of the invention.
Figure 3B:
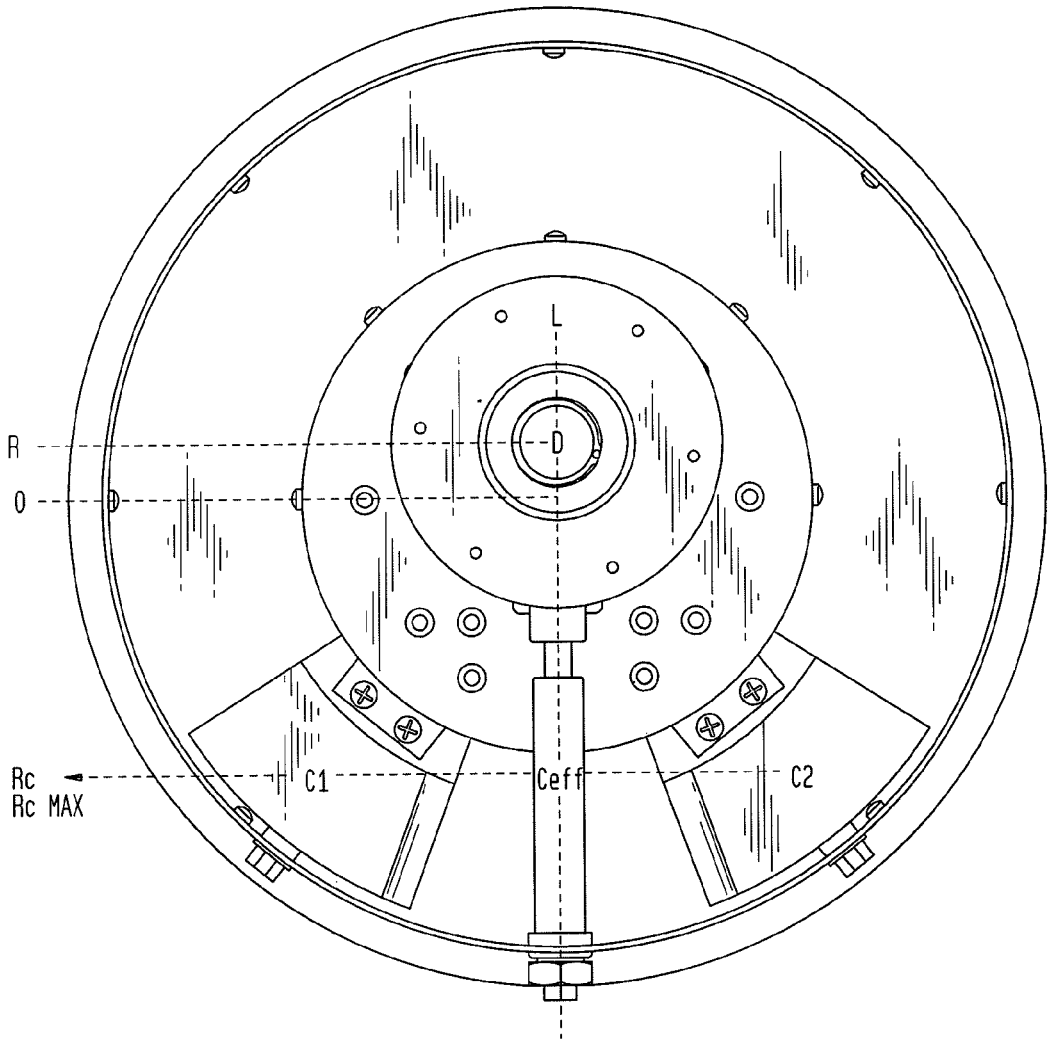
FIG. 3B is another top view of the counterweight rotor assembly with counterweights moved to another position, in accordance with an embodiment of the invention.
Figure 3C:
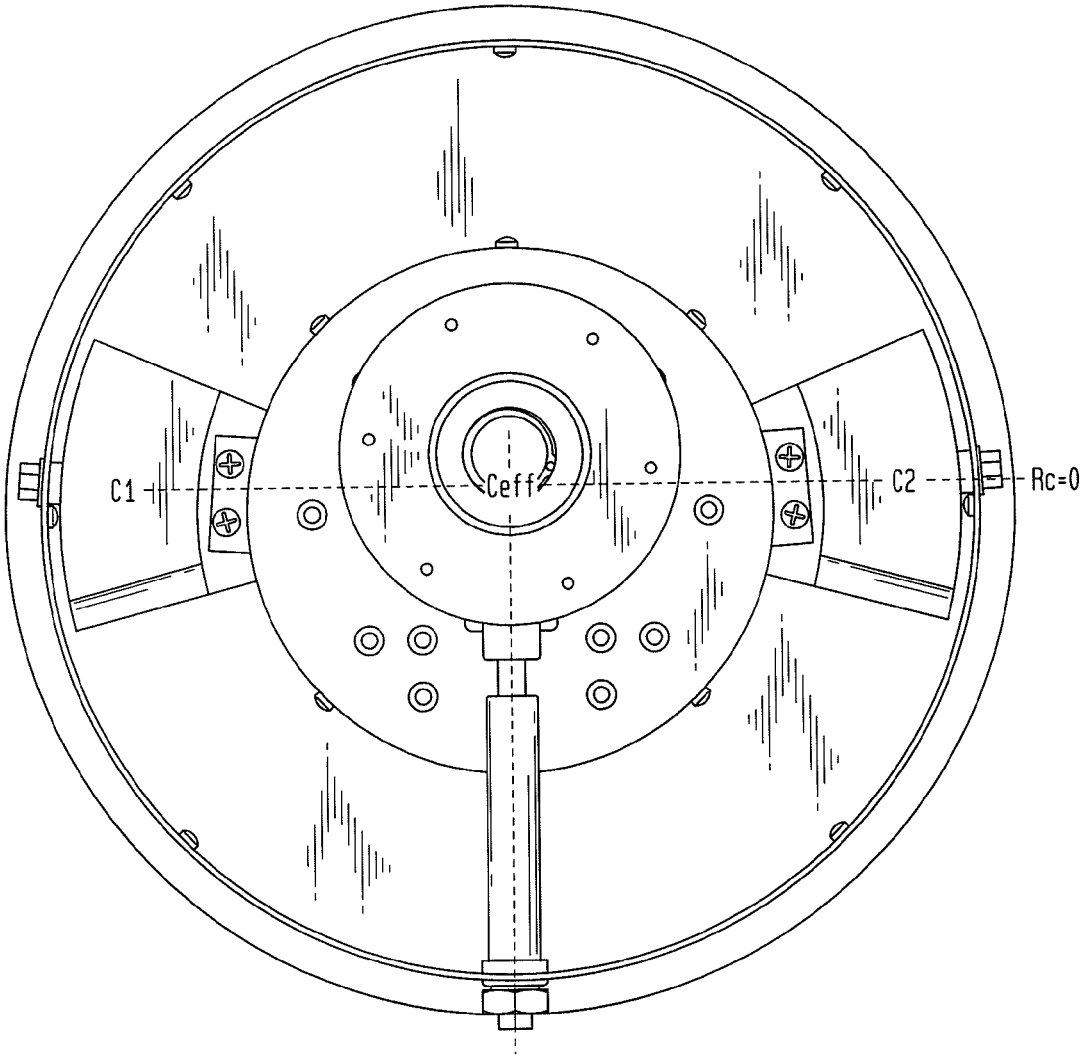
FIG. 3C, is another top view of the counterweight rotor assembly with counterweights moved to another position, in accordance with an embodiment of the invention.

FIGS. 3A, 3B and 3C illustrate exemplary distributions of the various system loads and a method whereby the present invention accomplishes static balancing. Normally, a single counterweight is selected to balance the static moment generated by the dead and live platform loads. The dead load is defined as the portion of the total system mass which is rigidly coupled to the rotating platform. The live load is defined as the portion of the total system mass which is enclosed by the containers on the rotating platform and is typically a liquid solution. The necessary static balance from the counterweight can be expressed as a torque (in-lb) and is determined by multiplying the weight in the vertical direction by the distance between the line of action of the weight and the first shaft axis 14. For the dead load, this is simplified as a vertically-oriented force acting at the orbit radius R. For the live load, it is a vertically-oriented force acting at an orbit larger than R based upon agitation speed, the geometry of the media container (e.g., usually an Erlenmeyer flask) and the amount of fluid or the fill level of the container. Since the live and dead load weights and positions can vary depending upon the user's desires, a single counterweight acting at a fixed position may only statically balance one loading condition.

Instead of a single fixed counterweight, one aspect of the present invention is to divide this component into two equal counterweight wedges 40 which can be translated circumferentially about the rotor assembly 38. The benefits of this feature may best be observed in the top view of the rotor assembly.

FIG. 3A illustrates the relative positions of the live load L, dead load D, and individual centers of mass of the counterweight wedges, C1 and C2. The vertical line is the symmetry plane through the shaft axes 14, 28. The distances R, RL, and Rc are the static moment distances of the dead load, live load, and counterweight, respectively. In order to provide a static balance between the platform load and the counterweights, the following equation must be satisfied:

$$D \times R + L \times RL = Rc \times (C1 + C2) \quad (1)$$

where D=Dead load weight, L=live load weight, and C1 and C2 are the weights of the individual counterweight wedges.

The effective balancing contribution may be considered as the sum of the masses of the individual wedges multiplied by the distance from the axis of rotation of the first shaft of the rotor. As each counterweight wedge is moved, its center of mass also shifts. As the wedges are moved in unison away from each other, the effective center of mass of the combination of the two slides toward the center of the rotor. This decreases the moment arm over which the counterweight's mass acts, as shown in FIG. 3B, where Rc<Rc max, and thus reduces the static balancing contribution. In the extreme case, as shown in FIG. 3C, Rc shrinks to zero and the two counterweights cancel each other's contributions, thus providing no static balancing whatsoever.

The counterweight masses are designed such that Rc max× (C1+C2) is greater than or equal to the maximum conditions of R, RL, D, and L for a given orbital shaker. Based upon this, there will always be a counterweight position which can provide the proper static balance for any loading condition.

Since the platform load and counterweights orbit in different horizontal planes, they generate a dynamic imbalance which cannot be compensated by the two aforementioned counterweight wedges. In an embodiment of the invention, a second set of counterweights could be added to the system in a different vertical plane and adjusted in such a manner to compensate for the dynamic imbalance. These weights would be disposed in the same direction as the second shaft axis 28 relative to the first shaft axis 14 and be sized to accommodate the desired range of platform loads.

Figure 4:
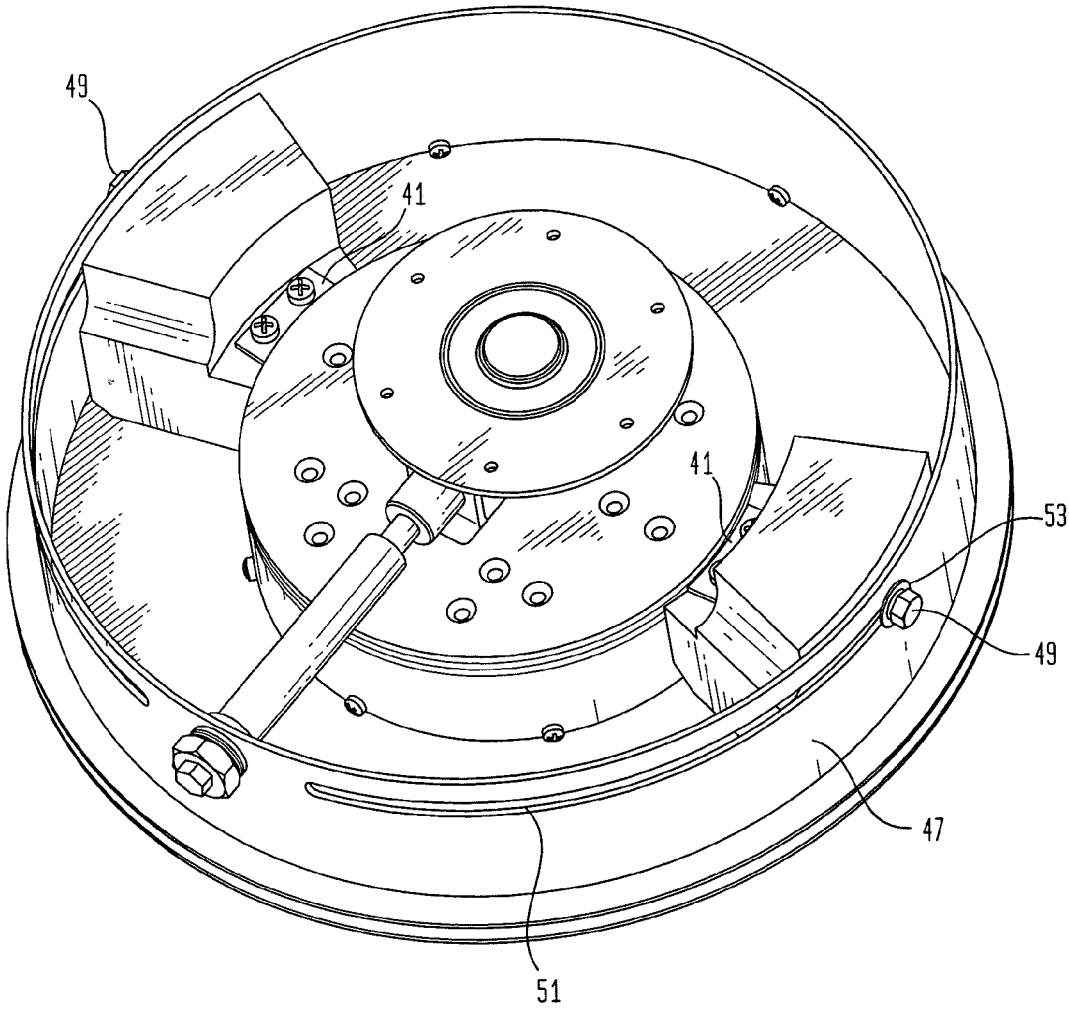
FIG. 4 is an isometric view of the rotor assembly illustrating the components involved in manually adjusting the counterweight wedges, in accordance with an embodiment of the invention.

There are several alternatives for manually adjusting the position of the counterweight wedges. In FIG. 4 illustrates an exemplary embodiment of the invention in which the counterweight wedges are vertically supported by the counterweight bearings 41 and a shoulder bolt 49 connection to the rotor drum 47. As described previously, the counterweight wedges are radially and vertically constrained but are free to move in circumferential rotation. The shoulder bolt connection passes through a slot 51 in the drum so that by tightening the bolt 49 and compressing a backing washer 53 the counterweight can be held at any circumferential position along the slot 51. The slot 51 can be provided with marks or gradations adjacent to it to assist the user in selecting the correct position for the counterweights 40 as a function of the platform load. In alternate embodiments, the bolt 51 may be replaced by a draw latch or compression latch for easier adjustment. In operation, the user could readily loosen the counterweight bolts to allow free rotation, make an adjustment to both counterweight wedges according to the load requirements, and tighten the bolts to fix the position of the counterweights.

Figure 5:
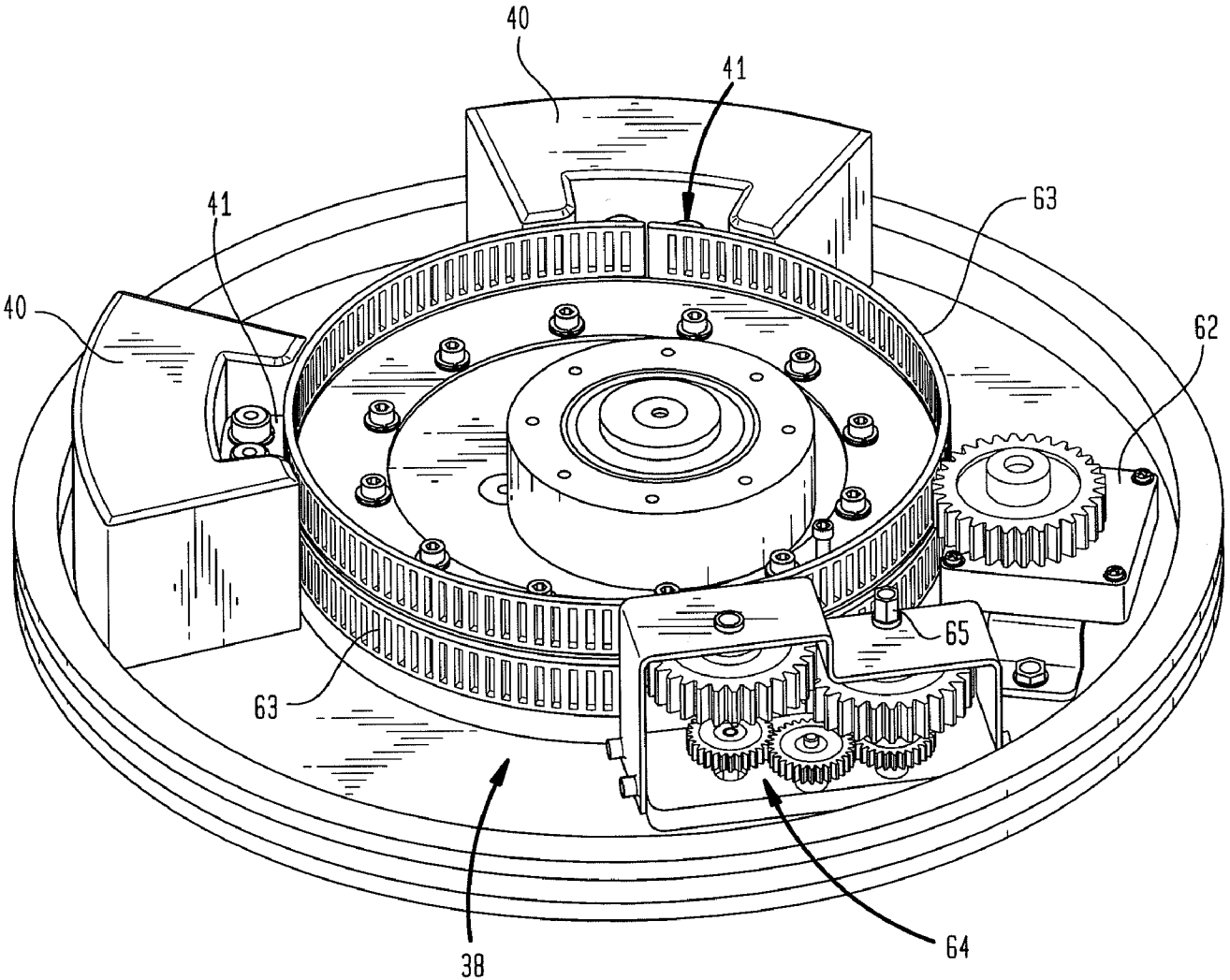
FIG. 5 is an isometric view of the rotor assembly illustrating an alternate embodiment for adjusting the counterweight wedges, and includes a view of the motor which is used for automatic counterweight adjustment, in accordance with an embodiment of the invention.
Figure 6:
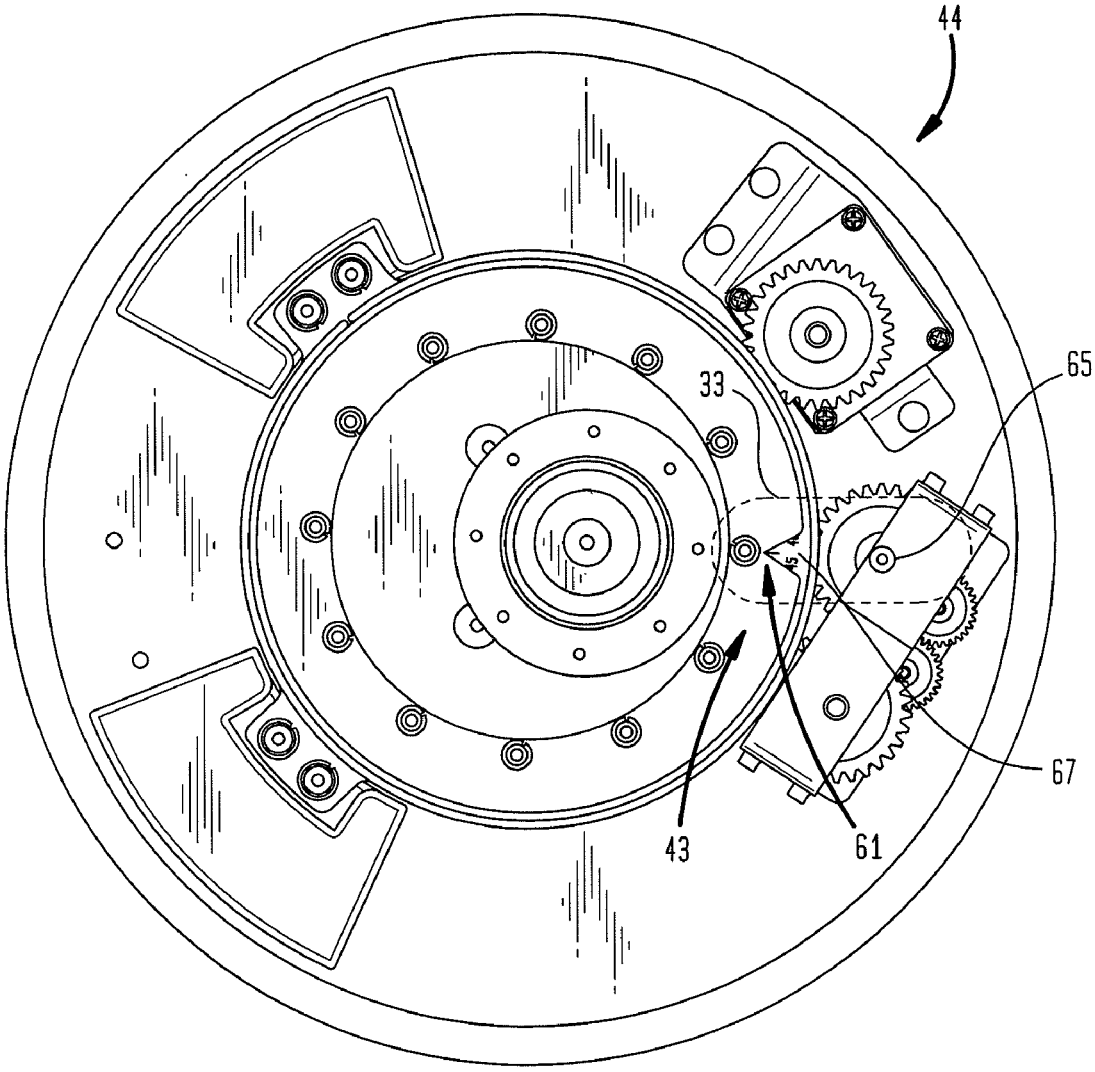
FIG. 6 is a top view of the embodiment depicted in FIG. 5, in accordance with an embodiment of the invention.

FIGS. 5 and 6 illustrate another exemplary embodiment of the invention for manually adjusting the position of the counterweight wedges. In this embodiment, gears 63 are added to the counterweight bearings 41, and a geartrain 64 is added to the counterweight rotor 38. The input shaft 65 of the geartrain is oriented vertically and is accessible through a hole 33 in the platform 44. The geartrain 64 meshes with the counterweight gears 63 and is designed so that the counterweights rotate in opposite directions from each other. Evenly-spaced markings or gradations 67 are added to the upper counterweight bearing ring 41 and a notch 61 is placed in the bearing cap 43 so that these marks can be seen by the user during adjustment. By turning the input shaft 65 clockwise or counterclockwise, the counterweights move closer to or further away from each other circumferentially and thus either increase or decrease the amount of imbalance compensation. In this embodiment, the counterweights 40 are supported vertically by rollers or low friction materials instead of the shoulder bolt 49 connections to the rotor drum 47.

In order to address varying user demands for effectively agitating a range of flasks and other samples on the platform, the crank throw/eccentric offset dimension, R, may be adjusted. This will change the amount of counterweight compensation necessary, as the effective radial load will increase or decrease as R is modified. Thus, allowing the adjustment of the crank throw must necessarily involve being able to adjust the static balance correction from the counterweights. The present invention provides this eccentric adjustment in an embodiment, as illustrated in FIGS. 7A and 7B.

Figure 7A:
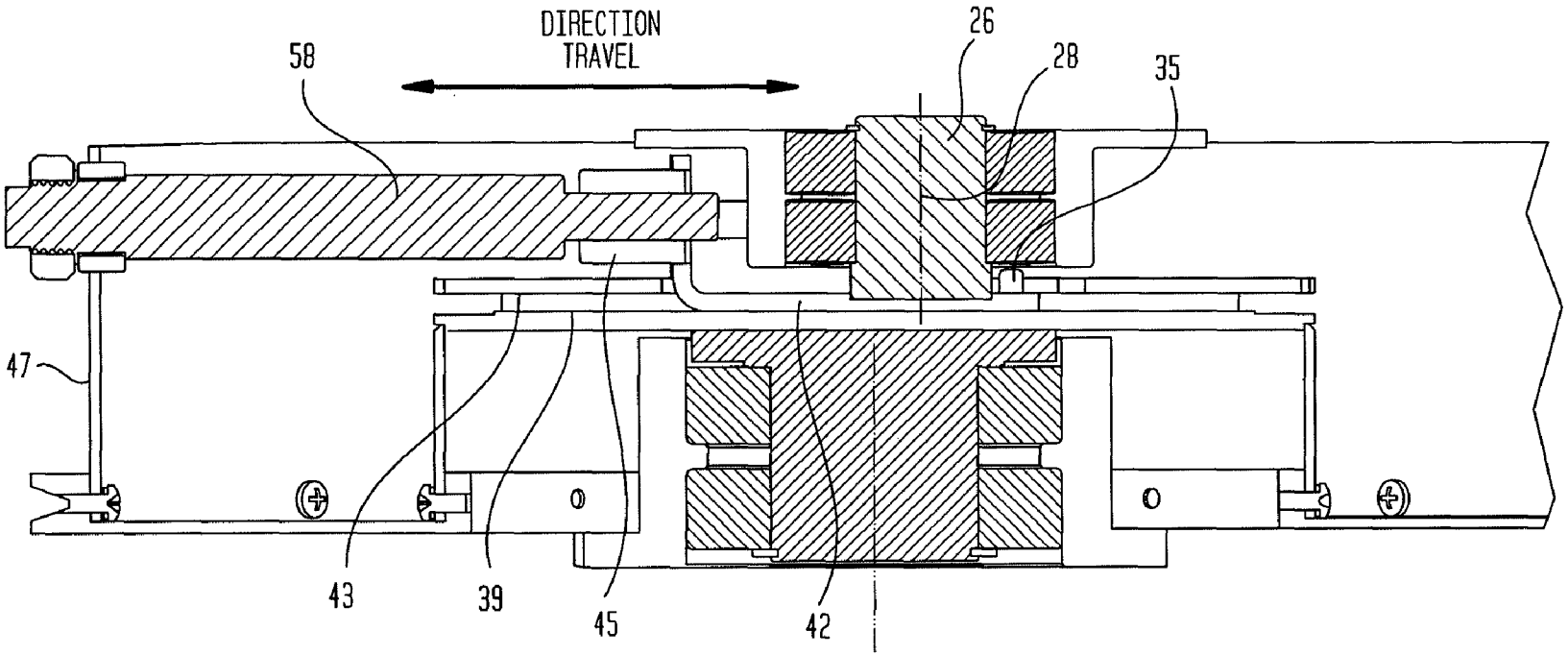
FIG. 7A is a cross section view of an elevation of the counterweight rotor assembly showing the method of manual adjustment of the eccentric offset, and a detail of the end of the adjustment rod, respectively, in accordance with an embodiment of the invention.
Figure 7B:
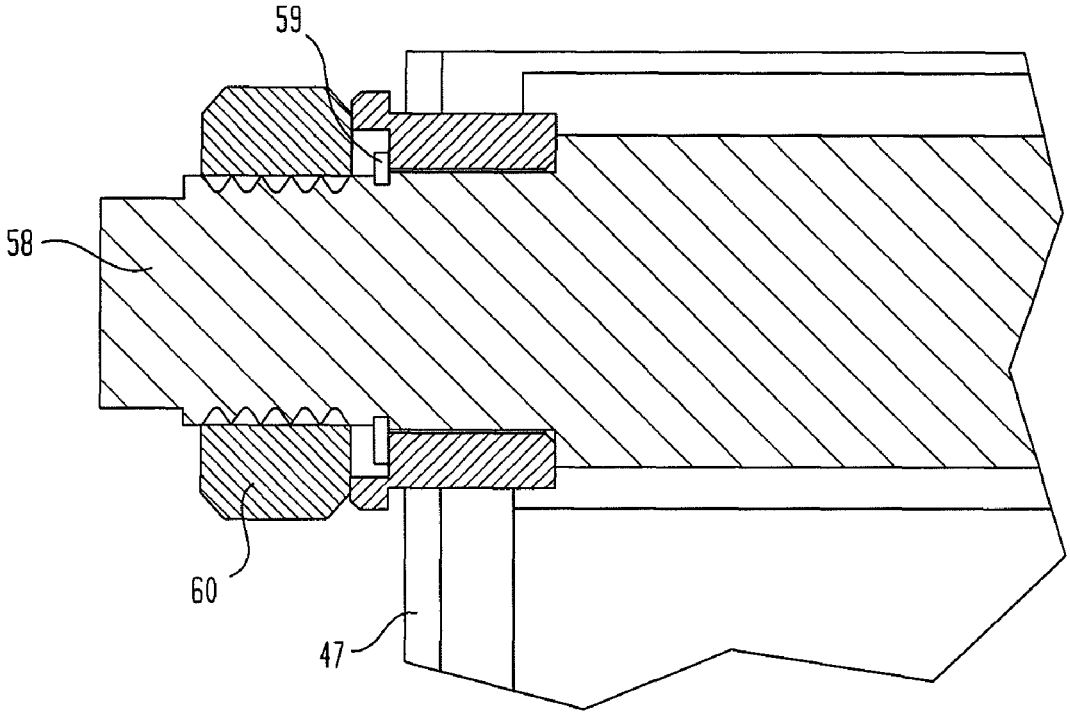
FIG. 7B is a cross section view of an elevation of the counterweight rotor assembly showing the method of manual adjustment of the eccentric offset, and a detail of the end of the adjustment rod, respectively, in accordance with an embodiment of the invention.

FIG. 7A shows that the second shaft 26 which has a second axis 28 offset from the first shaft axis 14 is rigidly coupled to a shaft slide 42. The shaft slide 42 has a flange with a nut 45 having a main axis oriented perpendicular to the second shaft axis 28 and parallel to the allowable direction of travel of the shaft slide. The shaft slide 42 is constrained laterally by a recess in the rotor pedestal 39 and is constrained vertically by the bearing cap 43. In an alternate embodiment, a dovetail slide can be substituted for the shaft slide 42. The shaft slide 42 has two pins 35 to provide a positive travel stop when they interfere with the bearing cap. The threaded nut 45 portion of the shaft slide 42 is connected to a threaded rod 58 which serves as a lead screw. The rod 58 is captured by the rotor drum 47 with a snap ring 59 so that the rod can rotate but cannot translate. Thus, as the rod 58 is turned the shaft slide 42 is free to move within its travel limits in the radial direction. This radial travel shifts the first and second shaft axes 14, 28 closer to or further away from each other, which results in an increased or decreased eccentric crank throw, R. A jam nut 60, when tightened, prevents the rod from rotating during operation of the orbital shaker, which would alter the orbit radius. A scale can be provided on the platform 44 for an indication to the user of the current eccentric offset, or the number of turns of the rod 58 can be correlated with this offset distance based upon the thread pitch.

In order to detect the onset of undesirable static imbalance, an embodiment of the invention requires an additional element. The preferred embodiment incorporates an accelerometer 54 mounted to the chassis 24 of the orbital shaker. This accelerometer 54 is sensitive to static and dynamic imbalances in three principal directions X, Y, Z. While the orbital shaker is operating, a supervisory electronic controller 56 reads the output signals from the axes and calculates an acceleration parameter, which can be defined as the following:

$$\text{Acceleration Parameter}=((X\text{-accel})^2+(Y\text{-accel})^2+(Z\text{-accel})^2)^{1/2} \quad (2)$$

Figure 8:
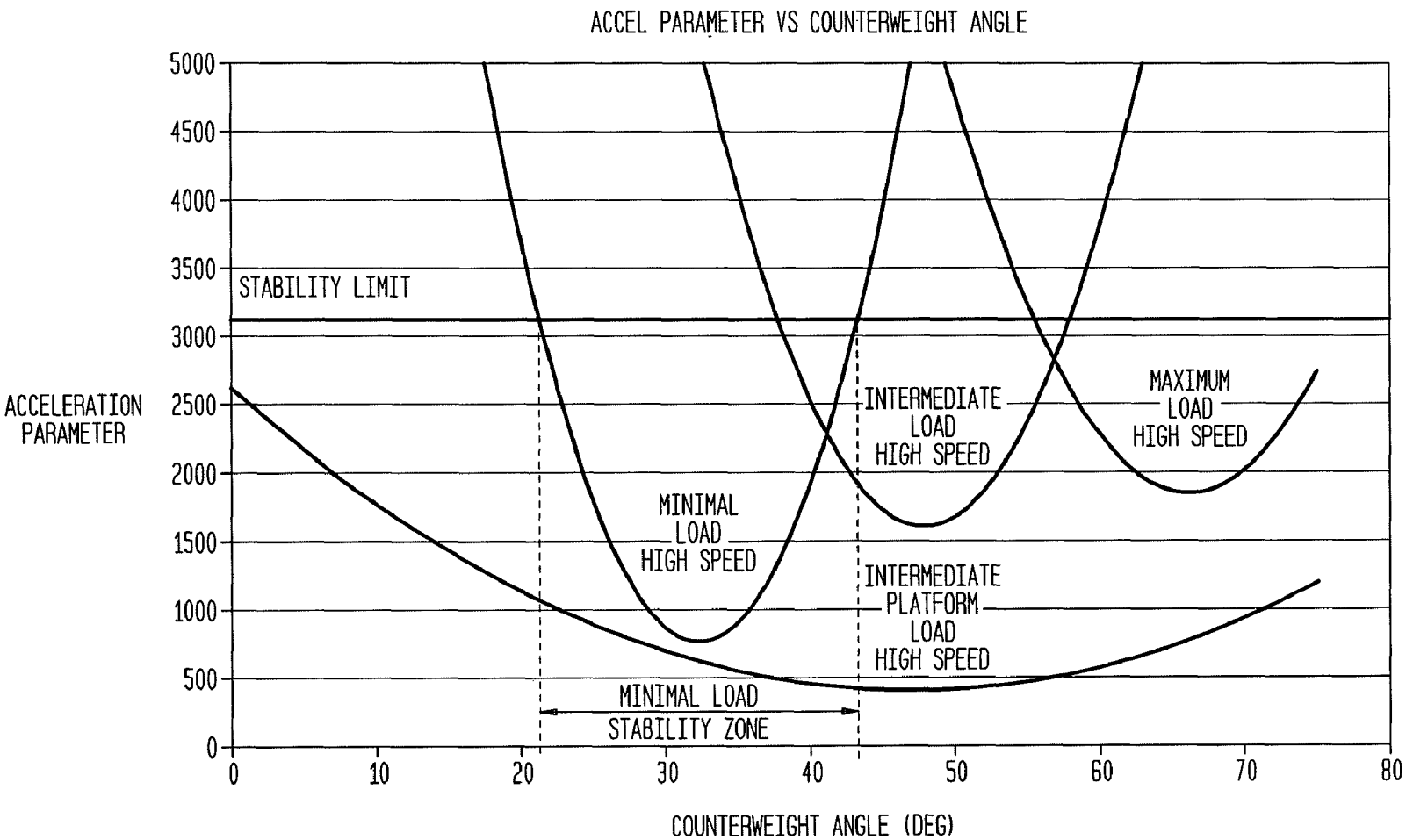
FIG. 8 illustrates the typically observed value of the acceleration parameter for a range of loading and operating conditions, in accordance with an embodiment of the invention.

The allowable limit for this parameter, hereinafter "the stability limit", permitted by the controller 56 will vary depending upon the load requirements, mass, and geometry of the orbital shaker. FIG. 8 provides a demonstration of the typically observed value of the acceleration parameter for a range of loading and operating conditions. The chart shows the measured acceleration parameter against the counterweight angle, where an increasing angle corresponds with increasing imbalance compensation.

The measured value of the acceleration parameter for a given loading condition and speed is roughly parabolic. A portion of this parabola lies below the stability limit and is called the stability zone. Any selected counterweight angle within this stability zone will yield acceptable operation. The stability zone decreases with increasing speed, and the minimum of the parabola increases with increasing platform load as the magnitude of the dynamic imbalance increases. Also, typically the minimum of the parabola for a given loading condition is within the stability zone for higher speed operation.

Figure 9:
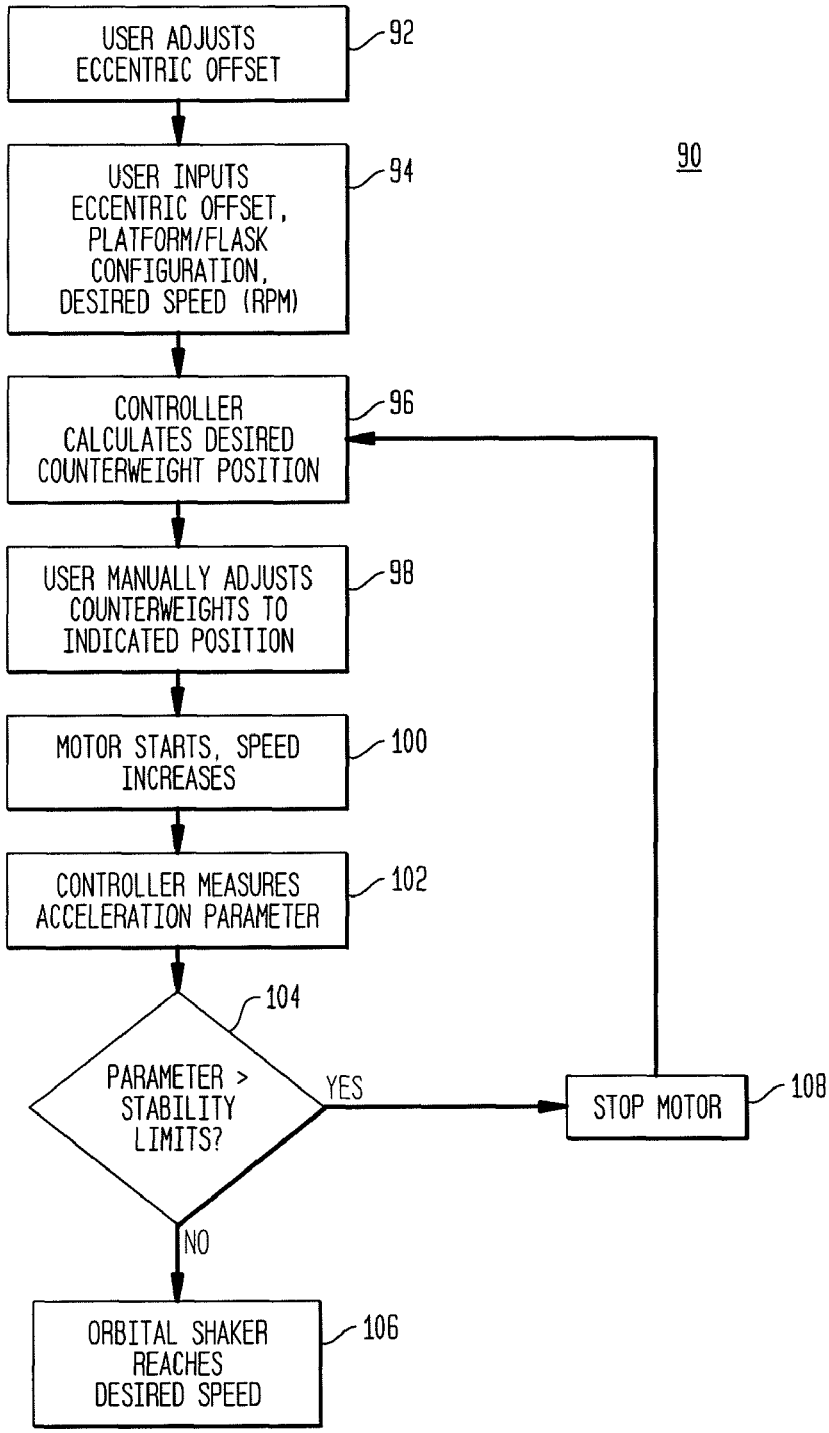
FIG. 9 is a flowchart for the operation of the manually-adjusted counterweight and eccentric orbit system, in accordance with an embodiment of the invention.

FIG. 9 provides an exemplary flowchart 90 for the operation of the manually-adjusted counterweight and eccentric orbit system according to an embodiment of the invention. In an embodiment of the invention, the user first adjusts the eccentric orbit 92. Next, through a user interface 55, such as, for example, a touchscreen, the user specifies the eccentric offset, the platform/flask configuration, and the desired speed (RPM) 94. Since the controller 56 monitors the onset of instability, it is not necessary to provide platform information except to reduce the time necessary to manually adjust the counterweights to the correct position. The controller 56 then calculates a first counterweight position 96, and the user adjusts the counterweights to this position 98 using the aforementioned method(s). The controller starts the motor 25 and increases the speed 100 while monitoring the acceleration parameter 102. So long as this parameter does not exceed the stability limit 104, the speed is increased until the desired speed is achieved 106. If the parameter exceeds the stability limit, then the motor is stopped 108 and the controller revises its calculation for the proper counterweight position 96.

Figure 12:
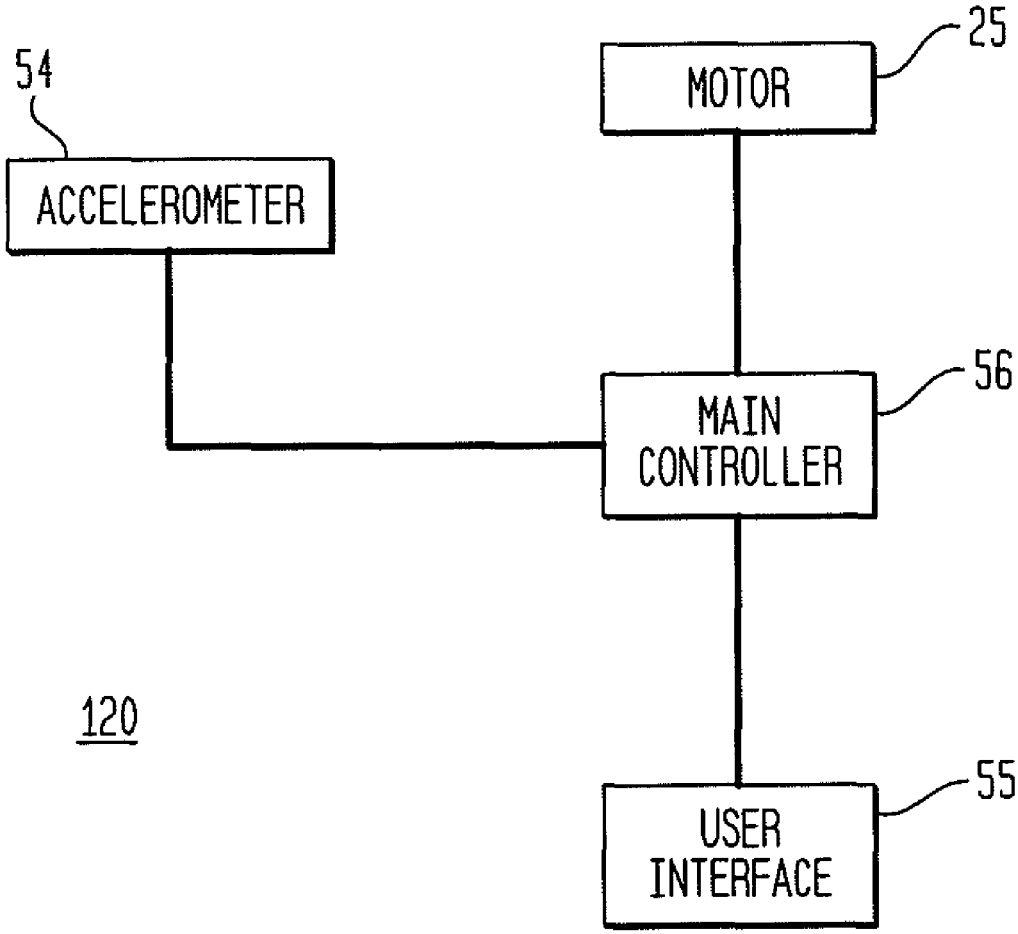
FIG. 12 is the system block diagram for the automatically-adjusted counterweight and eccentric orbit system, in accordance with an embodiment of the invention.

FIG. 12 depicts an exemplary system block diagram 120 for manual adjustment and monitoring of the counterweights and eccentric crank throw. In addition to these components needed for manual adjustment and monitoring, elements may be added for sensing and actuation of the counterweights and eccentric offset.

Figure 10:
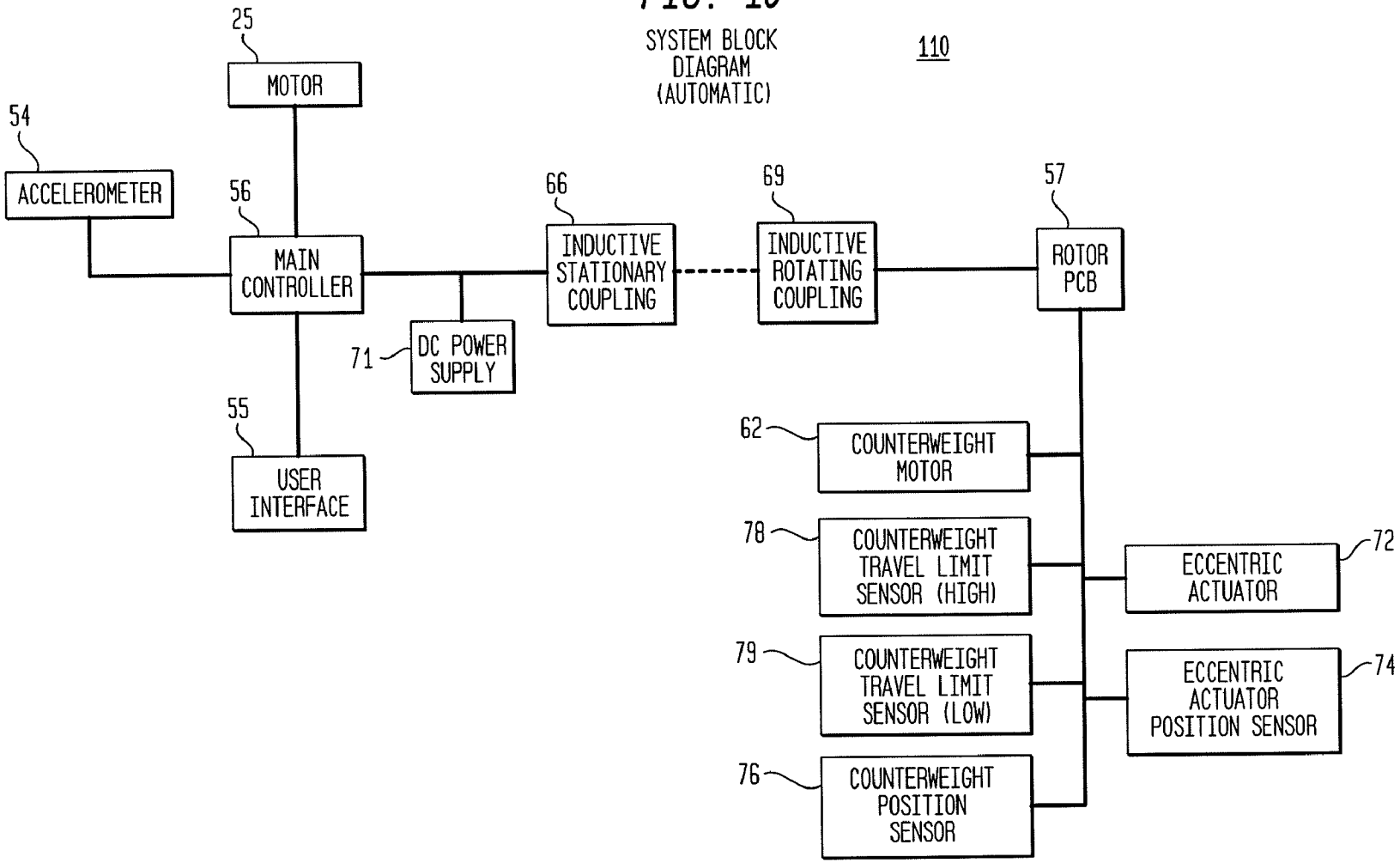
FIG. 10 is a system block diagram for the electronics of the manually adjustable embodiment, in accordance with an embodiment of the invention.

FIG. 10 provides an exemplary system block diagram 110 for various embodiments of the invention. It is understood that the main controller 56 includes at least one processor and associated computer memory (not depicted) specially configured to perform the described functionality. Persons of skill in the arts of processors understand that various alternative processors using various operating systems and memory configurations may be used to implement the systems and methods described. The main controller 56 is accessible to the user via a user interface 55. At a minimum, the user interface 55 includes a display providing information to the user and a keyboard or other input device allowing the user to communicate instructions and data to the controller 56. In a preferred embodiment of the invention, the user interface 55 is a touchscreen. The controller is also in operative communication with the motor 25, accelerometer 54, rotor PCB 57 counterweight motor 62, counterweight travel limit sensor (high) 78, counterweight travel limit sensor (low) 79, counterweight position sensor 76, eccentric actuator 72, and eccentric actuator position sensor 74 via inductive stationary coupling 66/inductive rotating coupling 69. All electrical components of all embodiments, including but not limited to the main controller 56, motor 25, accelerometer 54, and user interface 55 are provided electrical power by a DC power supply 71. Power and control signals are also provided to the rotor PCB 57 counterweight motor 62, counterweight travel limit sensor (high) 78, counterweight travel limit sensor (low) 79, counterweight position sensor 76, eccentric actuator 72, and eccentric actuator position sensor 74 via inductive stationary coupling 66/inductive rotating coupling 69. A preferred embodiment of the invention uses a Dayton permanent magnet gearmotor 2L005 as counterweight motor 62, a Honeywell HOA1405 reflective sensor for the counterweight position sensor 76, a Firgelli Automation Linear Actuator FA-240-S-12-1" as the eccentric actuator 72, and a MESA Systems DON100 HE30 for the inductive stationary coupling 66/inductive rotating coupling 69. Those of ordinary skill in the electronic arts understand that alternative means of providing power and control to the various electronic elements of the invention may be employed. It is also understood that alternatives to the preferred motors, sensors, actuators and couplings listed above may be employed.

A preferred embodiment for the invention which allows for automatic adjustment of the counterweights and the eccentric crank throw is now described. For automatic adjustment of the counterweights and the eccentric crank throw, a counterweight motor 62 is preferably added to the counterweight rotor 38 as indicated in FIG. 5 for adjusting the counterweights. The counterweight motor 62 engages one of the counterweight bearing gears 63 in order to cause it to rotate about the first shaft axis 14. The counterweight geartrain 64 ensures that both bearing gears 63 counter rotate in unison. This counter-rotation results in counter-translation of the counterweights, which is the desired motion for proper static balancing. Limit switches 78, 79 prevent operating the gear motor when the counterweights reach their travel limits. A counterweight position sensor 76, such as, for example, an optical encoder, or retroreflective sensor mounted to one of the counterweight wedges and capable of detecting the reflective/non-reflective transitions between the teeth of the counterweight geartrain 64, determines the location of the counterweights. The counterweight motor 62 is sized so that when the rotor accelerates or decelerates the counterweights do not generate enough torque to overcome the gear train and motor's inertial resistance.

Figure 11:
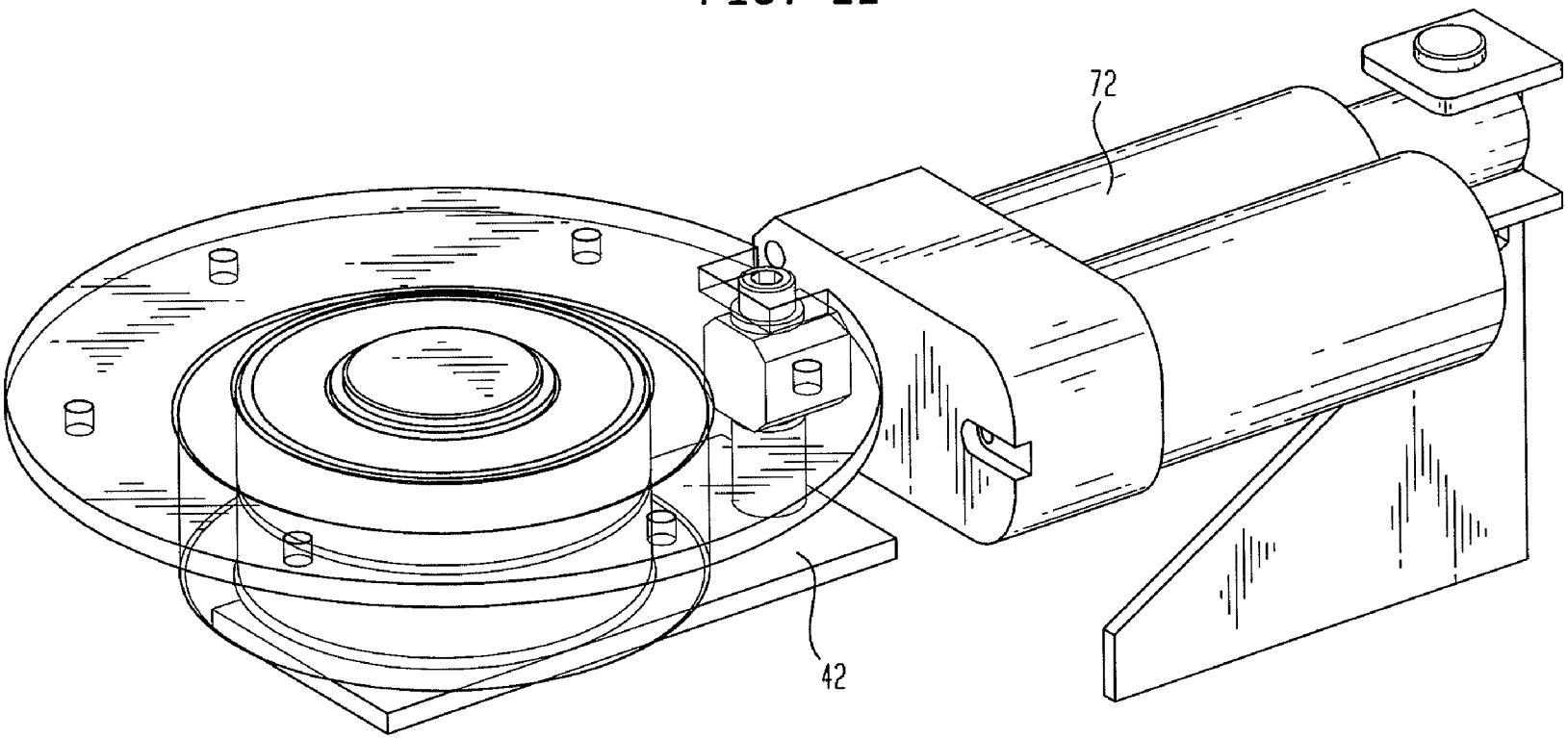
FIG. 11 shows a detail view of the eccentric actuator which is used to automatically adjust the orbit diameter of the orbital shaker, in accordance with an embodiment of the invention.

For changing the eccentric crank throw, an actuator 72 as in FIG. 11 is placed between the rotor drum and the shaft slide 42. This actuator replaces the rod 58 and contains a lead screw which is sized to resist the maximum centripetal force generated by the platform without turning, which would change the crank throw dimension, R. The actuator can contain or be used in conjunction with position sensor 74, such as an LVDT or potentiometer so that the position of the actuator can be determined and sent to the main controller.

Figure 13:
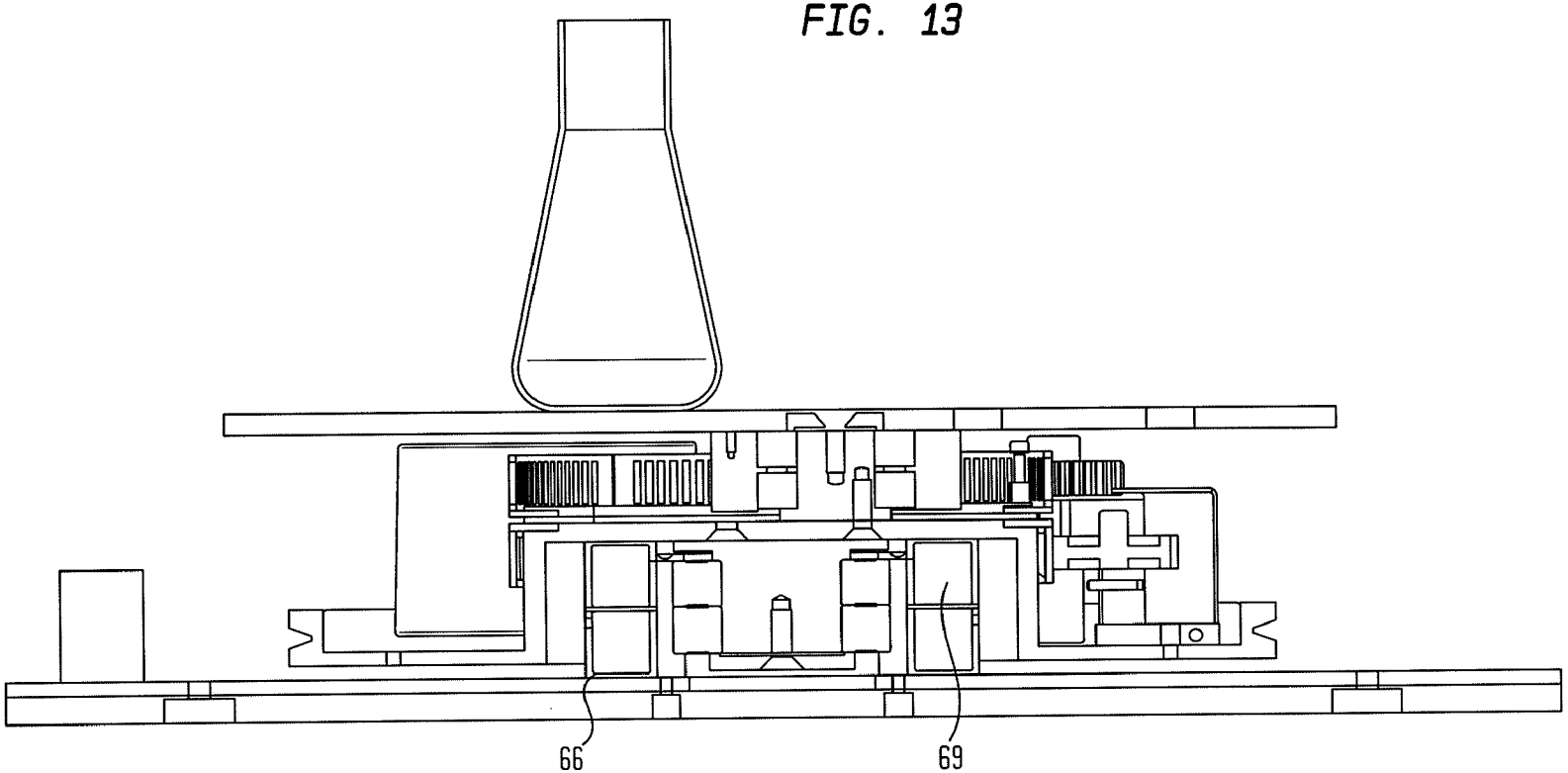
FIG. 13 is a cross section elevation view of the rotor assembly showing the position of the inductive coupling which supplies power and transfers electronic signals to and from the rotor, in accordance with an embodiment of the invention.

As shown in FIG. 13, in order to provide electrical power and control signals to the actuators on the spinning rotor in an embodiment of the invention, an inductive coupling is placed in the space between the rotor pedestal and the lower shaft housing. One half of the coupling is fixed to the housing, while the other is connected to the rotor. Signal and power are transmitted across an air gap between the two components. In other embodiments, this electrical connection can be made using a slip ring, or an electrically conductive fluid coupling.

Figure 14:
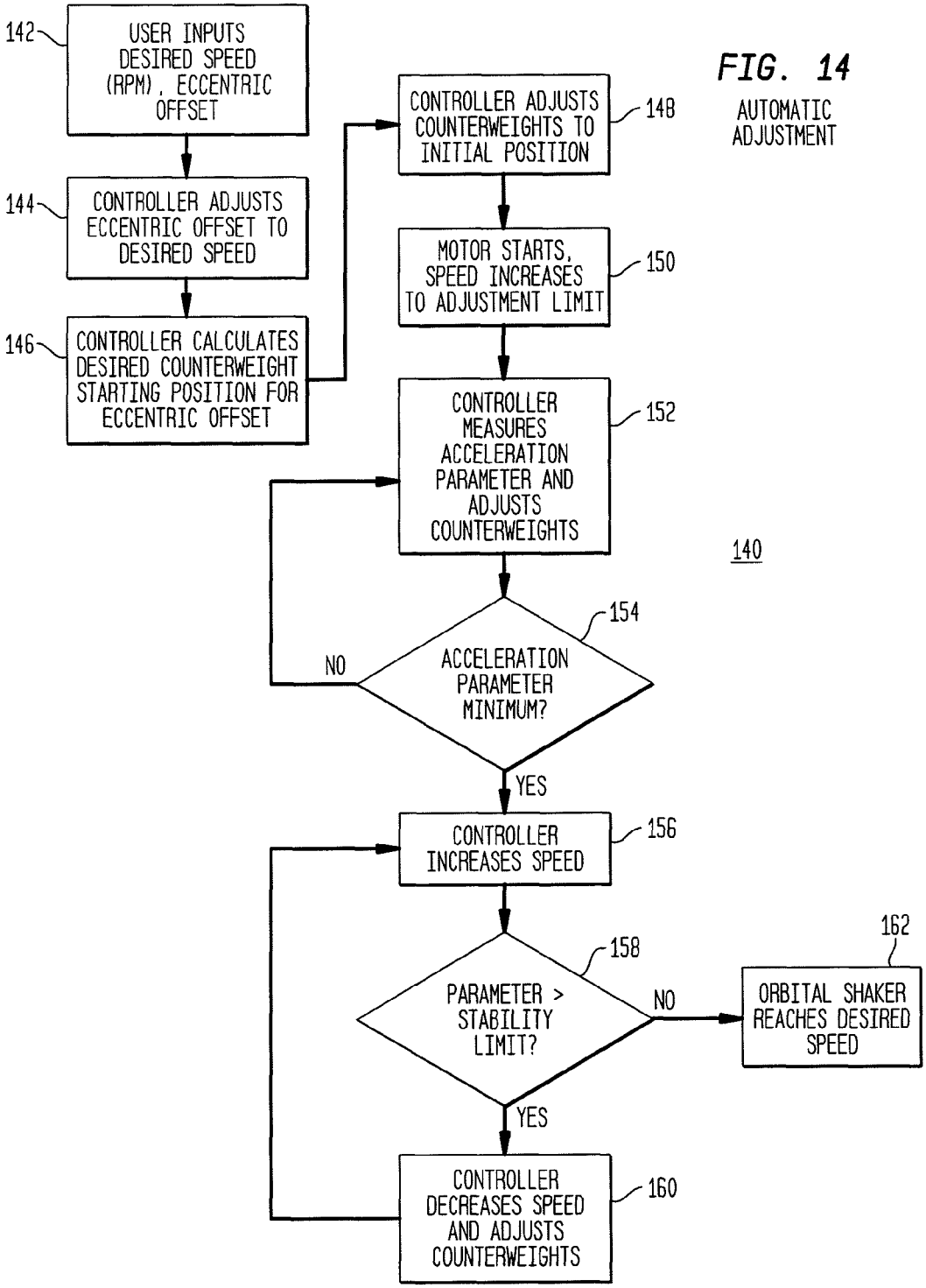
FIG. 14 provides the process flowchart for automatic adjustment of the eccentric offset and counterweight wedges, in accordance with an embodiment of the invention.

FIG. 14 describes an exemplary process 140 for automatic adjustment. In an embodiment of the invention, the user inputs 142 the desired speed and eccentric offset into the user interface 55. The controller 56 automatically adjusts the eccentric offset to the desired position 144 using the eccentric actuator 72 and the position sensor 74. The controller calculates the desired counterweight starting position given the eccentric offset 146. This calculation is performed using a formula where the cosine of half the angle between the counterweight wedge centers of mass equals the eccentric offset R multiplied by the known system dead load, divided by the product of the total counterweight mass multiplied by the fixed radial distance to the known counterweight center of mass, according to FIG. 3A This position balances the system neglecting the additional contributions of any containers, their contents, and the mounting hardware attached to the platform. The controller then actuates 148 the counterweights to their initial position using the counterweight motor 62 and travel low limit sensor 79. Next, the controller, starts the shaker motor 25 and increases the speed to the adjustment limit 150, which is the speed at which the counterweight motor 62 is still capable of repositioning the counterweights without exceeding its torque/current limitations. The controller measures 152 and calculates the acceleration parameter while increasing the angular position of the counterweights in order to minimize the acceleration parameter 154. The controller increases the motor speed 156, while checking that the acceleration parameter remains below the stability limit 158. If the acceleration parameter exceeds the stability limit, the controller then decreases the speed and adjusts the counterweights 160, and then increases the speed again 156. Otherwise, the shaker reaches the desired speed 162.

Figure 15:
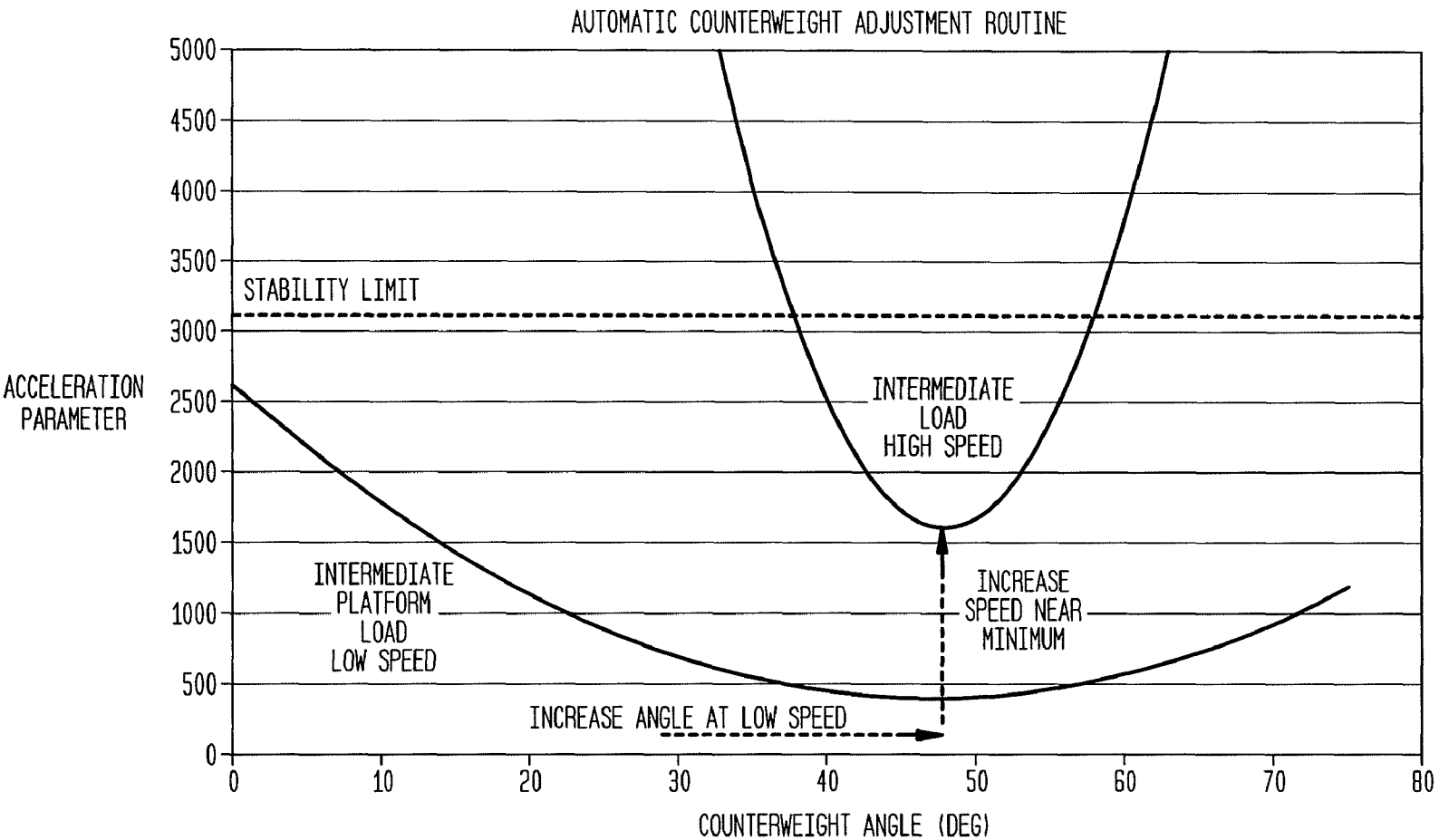
FIG. 15 is a further, graphical explanation of the automatic counterweight adjustment routine, in accordance with an embodiment of the invention.

FIG. 15 graphically demonstrates this automatic counterweight adjustment routine. Once a suitable minimum value has been achieved, the controller increases the motor 25 speed without additional counterweight adjustment, and monitors the stability parameter while the shaker approaches the desired operating speed. If the parameter is exceeded, the controller decreases the speed and makes a further adjustment to the counterweights, compensating for live-load imbalance contributions which can change in magnitude depending upon rotational speed.

For improved positioning of the counterweights, a load cell or strain gauge (not depicted) may be mounted to the eccentric adjusting rod or included in the eccentric actuator, so that the centripetal force generated by the platform load can be measured.

Having thus described the invention of the present application in detail and by reference to illustrative embodiments thereof, it will be apparent that modifications and variations are possible without departing from the scope of the invention defined in the appended claims.

What is claimed is:

1. An orbital shaker apparatus comprising:

a platform further comprising supports for objects to be secured to the platform;

a first shaft connected to a first bearing assembly at a first end and a mounting portion at a second end, the first shaft rotatable about a first shaft axis, the first shaft connected to a motor for rotation, the first bearing assembly mounted on a chassis;

a second shaft having a second bearing assembly mounted on the mounting portion at one end and the platform at the other end, the second shaft aligned parallel to the first shaft and offset from the first shaft by a distance R; and, a counterweight rotor assembly rigidly coupled to the mounting portion, the counterweight rotor assembly rotatable by a belt driven by a pulley connected to a rotating shaft of a counterweight motor, the counterweight rotor assembly further comprising two counterweight bearings, each of the two counterweight bearings attached to a counterweight wedge, the counterweight bearings rotatable about the rotor assembly and constrained from motion in a direction orthogonal to the plane of rotation by a cap on a pedestal portion rigidly coupled to the first shaft, the two counterweight wedges being positioned symmetrically with respect to a line formed by the intersection of a plane through the first and second shaft axes and the plane of rotation of the counterweight wedges, the counterweight wedges being held in position by a fastener;

wherein, in use, as the counterweight rotor rotates, the second shaft, second bearing assembly, and platform describes a circular orbit with diameter 2R.

2. The orbital shaker apparatus according to claim 1 further comprising a flexure apparatus for constraining platform rotation to a circular orbit.

3. The orbital shaker apparatus according to claim 1 further comprising two or more additional shafts and bearing assemblies for constraining platform rotation to a circular orbit.

4. The orbital shaker apparatus according to claim 1 further comprising a second pair of equal and circumferentially adjustable counterweights positioned at a different vertical location from the counterweight wedges to balance the load about the first axis.

5. The orbital shaker apparatus according to claim 1, wherein the fastener holding each counterweight wedge in place is a shoulder bolt passing through a slot in the rotor assembly compressing a backing washer.

6. The orbital shaker apparatus according to claim 5, wherein the counterweight positions are changeable by loosening the shoulder bolt for each counterweight wedge, moving each counterweight wedge, and retightening each shoulder bolt.

7. The orbital shaker apparatus according to claim 1 wherein each counterweight wedge is held in place by gears and a geartrain added to the counterweight rotor, the geartrain further comprising counterweight gears and an input shaft, and operating to rotate the counterweights in opposite directions from each other, the counterweight bearing ring further comprising a plurality of evenly spaced gradations, and a bearing cap having a visible notch;

wherein, in use to adjust the counterweight positions, the user turns the input shaft, thereby moving the counterweights.

8. The orbital shaker apparatus according to claim 1 further comprising a shaft slide rigidly coupled to the first shaft at one end and to the second shaft at the other end, the shaft slide further comprising an adjustment apparatus;

wherein the adjustment apparatus operates to change the distance R between the first and second shafts.

9. The orbital shaker apparatus according to claim 8 wherein the adjustment apparatus comprises a flange with a nut.

10. The orbital shaker apparatus according to claim 8 further comprising:

a controller in operative communication with a user interface, the motor and an accelerometer, the controller, user interface, motor and accelerometer further connected to a direct current power supply, the accelerometer mounted on the chassis, wherein, a user adjusts the adjustment apparatus to a desired distance R between the first and second shafts;

the controller further comprising a processor and associated computer memory configured to perform the method comprising:

accepting from the user the desired values for R, a platform/flask configuration, and the desired speed (RPM);

calculating a stability limit for the acceleration parameter for comparison with accelerometer readings;

calculating a first counterweight position for the user to adjust the counterweights to;

accepting from the user a command to start the motor;

monitoring the accelerometer and comparing its readings to the calculated stability limit while increasing the motor speed to the desired speed;

when the accelerometer readings exceed the stability limit, stopping the motor and repeating the calculating, accepting and monitoring steps with a revised counterweight position.

11. The orbital shaker apparatus according to claim 10 wherein the user interface is a touchscreen.

12. The orbital shaker apparatus according to claim 8 further comprising:

a controller in operative communication with a user interface, the motor and an accelerometer, the controller, user interface, motor and accelerometer further connected to a direct current power supply, the accelerometer mounted on the chassis;

wherein each counterweight wedge is held in place by gears and a geartrain added to the counterweight rotor, the geartrain further comprising counterweight gears and an input shaft, and operating to rotate the counterweights in opposite directions from each other, the input shaft driven by a counterweight motor, the counterweight motor controlled by the controller, and wherein a user adjusts the adjustment apparatus to a desired distance R between the first and second shafts;

the controller further comprising a processor and associated computer memory configured to perform the method comprising:

accepting from the user the desired values for R, a platform/flask configuration, and the desired speed (RPM);

calculating a stability limit for the acceleration parameter for comparison with accelerometer readings;

calculating a first counterweight position for the user to adjust the counterweights to;

adjusting the counterweight positions using the counterweight motor;

monitoring the accelerometer and comparing its readings to the calculated stability limit while increasing the motor speed;

wherein if the accelerometer readings exceed the stability limit, repeating the calculating, accepting and monitoring steps with a revised counterweight position and readjusting the counterweight positions using the counterweight motor;

wherein when the desired speed is reached, continue monitoring the accelerometer and comparing its readings to the calculated stability limit.

13. The orbital shaker apparatus according to claim 12 further comprising:

a counterweight position sensor, a counterweight travel limit sensor—high and a counterweight travel limit sensor—low; each in operable communication with the controller and provided electrical power by the DC power supply;

wherein the controller uses readings from the counterweight travel limit sensors and the counterweight position sensor to position the counterweights.

14. The orbital shaker apparatus according to claim 12 further comprising: an inductive coupling for providing control signals and power to the counterweight actuator and other electrical components located on the non-stationary portion of the shaker apparatus, the inductive coupling comprising an inductive stationary coupling and an inductive rotating coupling.

15. The orbital shaker apparatus according to claim 8 further comprising:

a controller in operative communication with a user interface, the motor and an accelerometer, the controller, user interface, motor and accelerometer further connected to a direct current power supply, the accelerometer mounted on the chassis;

a shaft slide rigidly coupled to the first shaft at one end and to the second shaft at the other end, the shaft slide further comprising an adjustment apparatus under the control of the controller, wherein the adjustment apparatus operates to change the distance R between the first and second shafts;

wherein each counterweight wedge is held in place by gears and a geartrain added to the counterweight rotor, the geartrain further comprising counterweight gears and an input shaft, and operating to rotate the counterweights in opposite directions from each other, the input shaft driven by a counterweight motor, the counterweight motor controlled by the controller;

the controller further comprising a processor and associated computer memory configured to perform the method comprising:

accepting from the user the desired values for R, a platform/flask configuration, and the desired speed (RPM);

calculating a stability limit for the acceleration parameter for comparison with accelerometer readings;

calculating a first counterweight position for the user to adjust the counterweights to;

adjusting the adjustment apparatus to a desired distance R between the first and second shafts;

adjusting the counterweight positions using the counterweight motor;

monitoring the accelerometer and comparing its readings to the calculated stability limit while increasing the motor speed;

wherein if the accelerometer readings exceed the stability limit, repeating the calculating, accepting and monitoring steps with a revised counterweight position and readjusting the counterweight positions using the counterweight motor;

wherein when the desired speed is reached, continue monitoring the accelerometer and comparing its readings to the calculated stability limit.

16. The orbital shaker apparatus according to claim 1 further comprising a dovetail slide rigidly coupled to the first shaft at one end and to the second shaft at the other end, the dovetail slide further comprising an adjustment apparatus;

wherein the adjustment apparatus operates to change the distance R between the first and second shafts.

* * * * *